US006825599B2

(12) United States Patent
Lim

(10) Patent No.: US 6,825,599 B2
(45) Date of Patent: Nov. 30, 2004

(54) CRT CONTAINING IMPROVED SLOT SHAPE OF SHADOW MASK

(75) Inventor: Min-Ho Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/927,361

(22) Filed: Aug. 13, 2001

(65) Prior Publication Data

US 2002/0101148 A1 Aug. 1, 2002

(30) Foreign Application Priority Data

Jan. 31, 2001 (KR) ..... P2001-4431

(51) Int. Cl.[7] ..... H01J 29/80
(52) U.S. Cl. ..... 313/403; 313/402
(58) Field of Search ..... 313/402, 403, 313/404, 405, 406, 407, 408

(56) References Cited

U.S. PATENT DOCUMENTS 4,300,070 A * 11/1981 Godfrey et al. ..... 313/403
4,631,440 A * 12/1986 Robbins ..... 313/403
4,751,425 A * 6/1988 Barten ..... 313/403
5,583,391 A * 12/1996 Good et al. ..... 313/402

* cited by examiner

*Primary Examiner*—Nimeshkumar D. Patel
*Assistant Examiner*—Karabi Guharay
(74) *Attorney, Agent, or Firm*—Birch, Stewart, Kolasch & Birch, LLP

(57) ABSTRACT

Disclosed is a CRT(Cathode Ray Tube), in which lengths of vertical axes(Y-axes) of outermost row slots of a long side of a shadow mask, slots adjacent to the outermost row slots in a central direction of the shadow mask and slots adjacent to the adjacent slots in a central direction of the shadow mask are maintained in the range of 70%~110% of a length of a vertical axis (Y-axis) of a perfect slot, thereby providing a visually stable screen. The color CRT includes a panel having a luminescent screen on an inner surface thereof, a funnel connected to the panel, an electron gun mounted on a neck part of the funnel, the electron gun emitting electron beams toward the luminescent screen, a shadow mask disposed in a fixed interval to the luminescent screen formed on the inner surface of the panel, the shadow mask serving to select colors, and a frame fixing and supporting the shadow mask, wherein the shadow mask includes an effective surface having a plurality of slots and a non-effective surface surrounding the effective surface, wherein the slots includes first slots arranged on an outermost row arranged in a vertical axis direction of the effective surface of the shadow mask, second slots being adjacent to the first slots in the vertical axis direction, third slots being adjacent to the second slots in the vertical axis direction, and fourth slots being adjacent to the third slots in the vertical axis direction; and wherein a length of the vertical axis direction of the first slots is in the range of 70%~110% of a length of the vertical axis direction of the fourth slots. The color CRT can prevent the formation of convexo-concave form on a luminescent body, white spots generated on an end of the effective surface, and stains generated on a periphery of the screen, thereby providing a stable screen.

8 Claims, 5 Drawing Sheets

CRT CONTAINING IMPROVED SLOT SHAPE OF SHADOW MASK

BACKGROUND OF THE INVENTION

1. Field of the Invention

The present invention relates to a CRT (Cathode Ray Tube), and more particularly, to a CRT, in which lengths of vertical axes (Y-axes) of outermost row slots of a long side of a shadow mask, slots adjacent to the outermost row slots in a central direction of the shadow mask and slots adjacent to the adjacent slots in a central direction of the shadow mask are maintained in the range of 70%~110% of a length of a vertical axis (Y-axis) of a perfect slot, thereby providing a visually stable screen.

2. Description of the Background Art

As shown in FIG. 1, a conventional CRT (Cathode Ray Tube) includes a fluorescent surface 4 of R, G and B colors coated on an inner surface thereof, a panel 1 having a front surface on which an explosion-proof glass is fixed, a funnel 2 fused to a rear end of the panel, an electron gun 3 inserted into a neck part 12 of the funnel and emitting electron beams 10, a shadow mask 5 mounted on an inner surface of the panel in a regular interval and having a plurality of holes for passing the electron beams, a frame 6 fixing and supporting the shadow mask and for maintaining the shadow mask in the regular interval from the inner surface of the panel, an inner shield 11 for shielding the CRT so as to reduce effects from the earth's magnetism, and a reinforcing band 7 mounted on the circumference of a side part of the panel for preventing external shock.

Reference numeral 8 indicates a deflection yoke and reference numeral 9 indicates a spring.

As shown in FIG. 2, the shadow mask of the Background Art includes an effective surface 13 having a plurality of round or oval holes for passing electron beams 10 emitted from the electron gun 3, and a skirt part 14 partially etched and having a prescribed length for welding the frame supporting the shadow mask.

Referring to FIG. 3*a*, when the electron beams 10 emitted from the electron gun 3 pass the holes formed in the effective surface 13 of the shadow mask and strike the fluorescent surface 4 coated on the panel 1, a plurality of slots 15 of a fixed size are arranged horizontally and vertically in regular intervals to maintain the electron beams 10 in regular intervals. Bridges (B) are formed between the adjacent slots 15 in regular intervals to maintain the intensity after forming the shadow mask.

The CRT of the Background Art having the above structure has an inner surface of the panel having a curvature, and the shadow mask also has a curvature. Therefore, to give the effective surface the appearance of a flat rectangular shape when a user sees a screen, shapes of long and short sides of the effective surface of the shadow mask are calculated geometrically and manufactured in the form of a pin or a barrel.

It is not difficult to manufacture the short side of the shadow mask into a desired shape even though a horizontal interval (Ph) of the slots 15 is changed, but it is very difficult to manufacture the long side of the shadow mask by changing a vertical interval (Pu). This is due to vertical wave patterns.

Therefore, lengths of a vertical axis direction (Y-axis) of the outermost row slots of the long side of the shadow mask are made to differ according to the effective surface.

Thereby, because a shape of a long side end of the screen formed during an exposure process in a color CRT a convexo-concave shape is formed on upper and lower portions of the screen during the luminescence of the screen, thereby deteriorating the grade of the screen.

Referring to the drawings, the above problems will be described in more detail as follows:

As shown in FIG. 3*a*, when the outermost row slots formed along the long side, are formed in the convexo-concave shape, the shape of the end of the vertical axis direction of the screen formed during the exposure process is the convexo-concave form shown in FIG. 4. In the exposure process of the color CRT, an exposure device performs the exposure operation in the vertical axis direction to form graphite stripes on the inner surface of the panel. Thus, if the slots are more than a prescribed size, the light passing the slots of the shadow mask having the convexo-concave shape forms the graphite stripes of the same shape on the inner surface of the panel, and thereby the end of the effective surface of the screen has the convexo-concave shape during the luminescence of the screen. To remove the convexo-concave shape of the end of the effective surface, non-luminescent material must be coated on the stripes formed during the exposure process.

As shown in FIG. 3*b*, when the bridges between the outermost row slots of the vertical axis direction of the shadow mask and slots adjacent to the outermost row stats are removed and the slots are connected to the end of the effective surface and exposed, the effectual surface of the screen can have a straight line without the convexo-concave shape. However, as described later, the outermost row slots of the vertical axis direction of the shadow mask, in which the outermost row slots and the slots adjacent to the outermost row slots are connected and expanded, have a larger shadow mask transmissivity mask than other adjacent slots, which are not connected. Thus, the electron beams passing the slots are formed relatively large on the screen, and thereby continuous white spots are formed on the end of the effective surface of the screen according to the difference in brightness of the electron beams between the outermost row slots arranged in the vertical axis direction of the shadow mask and the adjacent slots during the luminescence of the screen by the electron beams. Two equations are provided below.

Shadow Mask Transmissivity

=area of slot/(horizontal interval of slots×vertical interval of slots)

Shadow Mask Transmissivity in the case of connecting the outermost row slots and the adjacent slots =(area of outermost row slots+area of the adjacent slots+area of bridges)/(horizontal interval of slot×vertical interval of slot)

When the bridges between the outermost row slots and slots positioned underneath the outermost row slots, which are located in the vertical axis direction of the shadow mask, are removed and the slots are connected to the end of the effective surface thereof, the portion where the slots are connected becomes lower in shadow mask intensity than a portion where the slots are not connected, when a curved surface of the effective surface of the shadow mask is formed, thereby causing a droop of the slots after the forming process of the shadow mask.

Moreover, if the slots of the same row number are formed in an entire area from the center of the shadow mask toward the periphery of the shadow mask by changing the vertical interval of the slots, vertical wave patterns may be formed on the screen due to an interference phenomenon between a scanning interval of the electron beams and the vertical interval of the slot.

SUMMARY OF THE INVENTION

It is, therefore, an object of the present invention to provide a CRT(Cathode Ray Tube) capable of preventing a formation of a convexo-concave shape on upper and lower portions of a screen during the luminescence of the screen by maintaining lengths of outermost row slots arranged in a vertical axis direction of a shadow mask, slots adjacent to the outermost row slots in a central direction of the shadow mask and slots adjacent to the adjacent slots in a central direction of the shadow mask in the range of 70~110% of a length of a vertical axis (Y-axis) of perfect slots.

It is another object of the present invention to provide a color CRT capable of removing continuous white spots generated on an end of an effective surface by removing bridges between the outermost row slots arranged in the vertical axis direction of the shadow mask and slots arranged underneath the outermost row slots and by connecting the slots to the end of the effective surface and preventing stains of a periphery of the screen generated by short slots, thereby providing a visually stable screen.

To achieve the above objects, the present invention provides a color CRT including a panel having a luminescent screen on an inner surface thereof, a funnel connected to the panel, an electron gun mounted on a neck part of the funnel, the electron gun emitting electron beams toward the luminescent screen, a shadow mask disposed in a fixed interval to the luminescent screen formed on the inner surface of the panel, the shadow mask serving to select colors, and a frame fixing and supporting the shadow mask, wherein the shadow mask includes an effective surface having a plurality of slots and a non-effective surface surrounding the effective surface; wherein the slots includes first slots on an outermost row arranged in a vertical axis direction of the effective surface of the shadow mask, second slots being adjacent to the first slots in the vertical axis direction, third slots being adjacent to the second slots in the vertical axis direction, and fourth slots being adjacent to the third slots in the vertical axis direction; and wherein a length of the vertical axis direction of the first slots is in the range of 70%~110% of a length of the vertical axis direction of the fourth slots.

A length of the vertical axis direction of the second slots is in the range of 70%~110% of a length of the vertical axis direction of the fourth slots, and a length of the vertical axis direction of the third slots is in the range of 70%~110% of a length of the vertical axis direction of the fourth slots.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
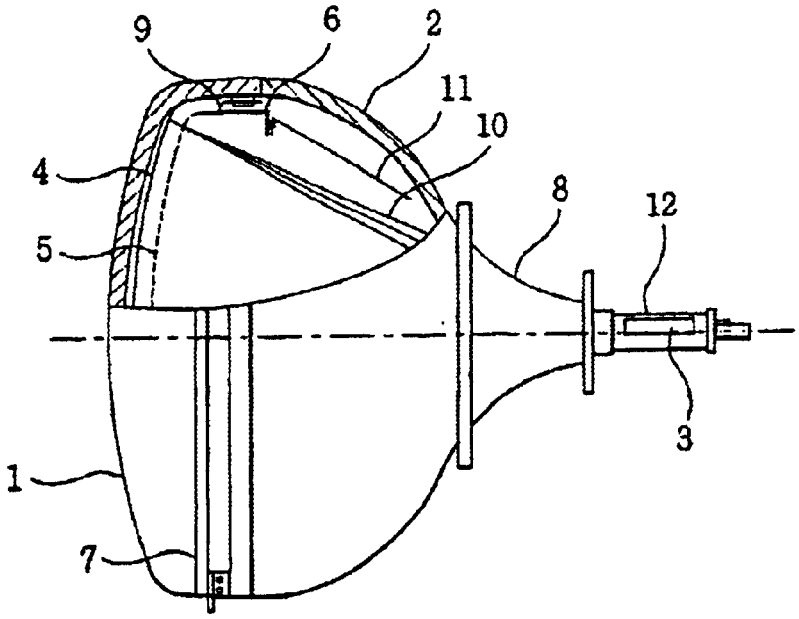
FIG.1 BACKGROUND ART
FIG. 1 is a sectional view of a color CRT(cathode Ray Tube) of the Background Art.
Figure 2:
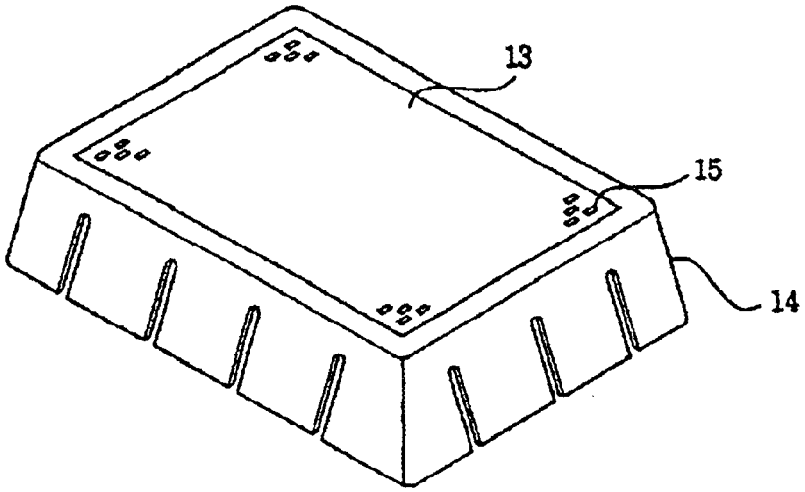
FIG.2 BACKGROUND ART
FIG. 2 is a perspective view of a shadow mask for the color CRT shown in FIG. 1.
Figure 3A:
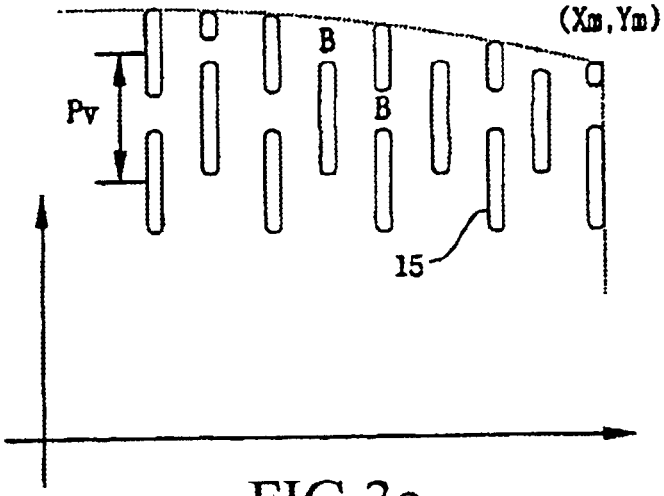
FIG.3a BACKGROUND ART
FIG. 3 is a view showing a shape of a slot of a shadow mask of the Background Art.
Figure 3B:
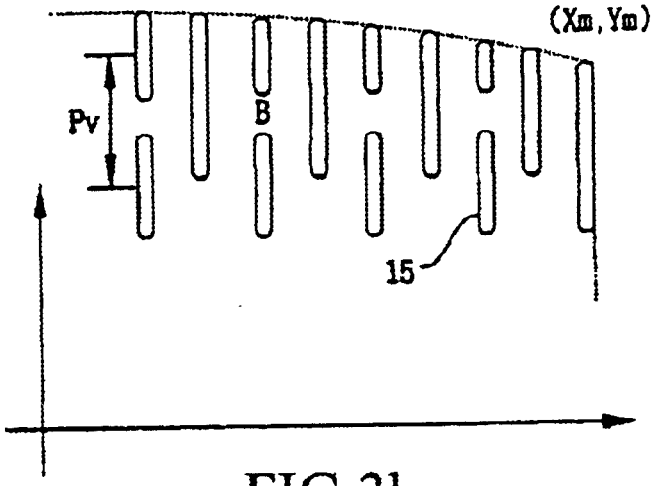
FIG.3b BACKGROUND ART
Figure 4:
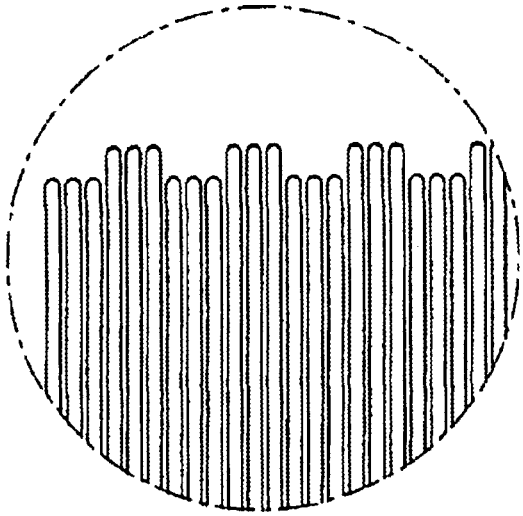
FIG.4 BACKGROUND ART
FIG. 4 is a view showing a shape of a screen by the shadow mask of the Background Art.

The present invention will now be described in detail in connection with preferred embodiments with reference to the accompanying drawings. For reference, like reference characters designate corresponding parts throughout several views.

In the present invention, slots are formed to have a luminescent body, radiated from an end of a long side of a shadow mask, not having a convexo-concave shape but having smooth screen edges (a straight effective surface).

Figure 5:
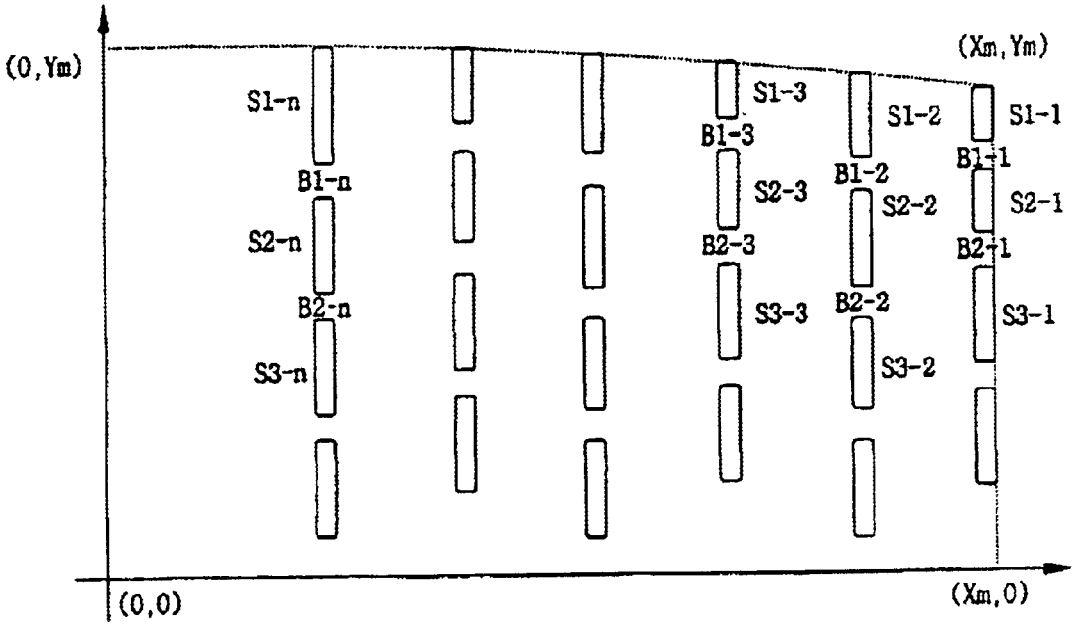
FIG. 5 is a view showing a shape of a slot according to an embodiment of the present invention.

As shown in FIG. 5, the long side end of the shadow mask refers to a portion near to a straight line connecting the outermost contours of the effective surface of the shadow mask from coordinates (-Xm, -Ym) to coordinates (Xm, -Ym) and a portion near to a straight line connecting the outermost contours of the effective surface of the shadow mask from coordinates (-Xm, Ym) to coordinates (Xm, Ym), when the central coordinates of the effective surface of the shadow mask are (0, 0) and the diagonal coordinates of the effective surface of the shadow mask are (Xm, Ym).

Figure 6:
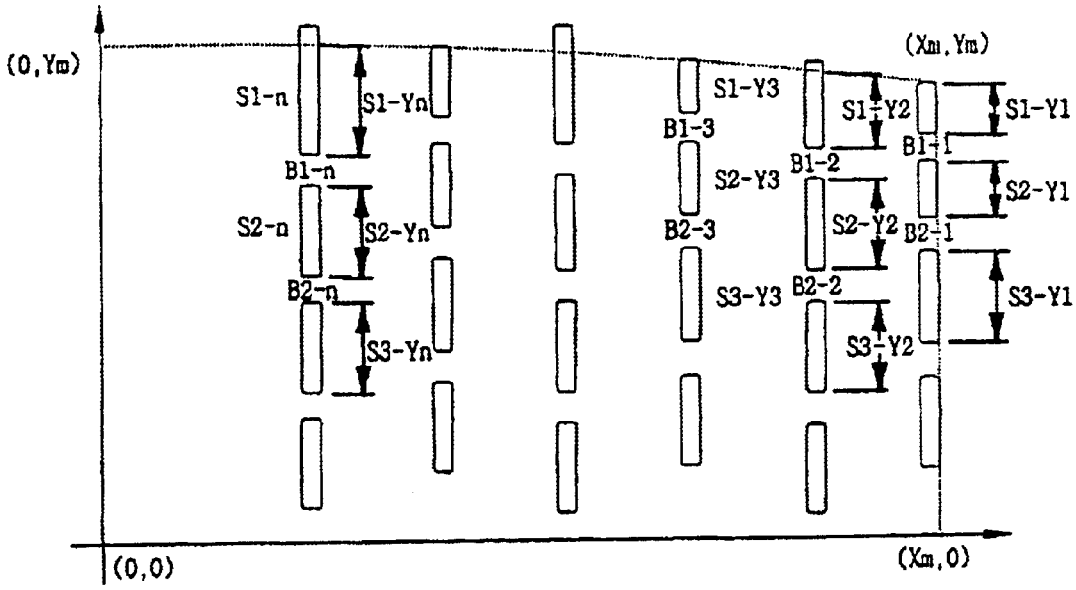
FIG. 6 is a view showing a shape of a slot according to another embodiment of the present invention.

As shown in FIGS. 5 and 6, outermost row slots of slots arranged parallel to a short axis, i.e., in a vertical axis direction are designated as first slots (S1_1, S1_2, S1_3, . . . and S1_n), lengths of Y-axes of the first slots are designated as S1_Y1. S1_Y2, S1_Y3, . . . and S1_Yn, slots adjacent to the first slots in a central direction of the shadow mask are designated as second slots (S2_1, S2_2, S2_3 . . . and S2_n), lengths of Y-axes of the second slots are designated as S2_Y1, S2_Y2, S2_Y3, . . . and S2_Yn, bridges between the first slots and the second slots are designated as B1_1, B1_2, B1_3, . . . and B1_n.

Furthermore, slots, which are adjacent to the second slots in a central direction of the shadow mask, are designated as third slots (S3_1, S3_2, S3_3, . . . and S3_n), lengths of Y-axes of the third slots are designated as S3_Y1, S3_Y2, S3_Y3, . . . and S3_Yn, and bridges between the second slots and the third slots are designated as B2_1, B2_2, B2_3, . . . and B2_n.

If the lengths of Y-axes (S1_Y1, S1_Y2, S1_Y3, . . . and S1_Yn) of the first slots (S1_1, S1_2, S1_3, . . . and S1_n) are more than 70% of those (S2_Y1, S2_Y2, S2_Y3, . . . and S2_Yn) of the second slots (S2_1, S2_2, S2_3, . . . and S2_n), the lengths of Y-axes of the first slots are left "as is" without change. If the lengths of Y-axes of the first slots are less than 70% of those of the second slots, bridges (B1_1, B1_2, B1_3, . . . and B1_n) are formed between the first and second slots and the lengths of the Y-axes of the second slots are made the same length as the Y-axes of the first slots.

At this time, if the lengths of the Y-axes of the second slots, which are equal to those of the first slots, are less than 70% of the lengths of the Y-axes (S3_Y1, S3_Y2, S3_Y3, . . . and S3_Yn) of the third slots (S3_1, S3_2, S3_3, . . . and S3_n), the Y-axes of the first, second and third slots are made in the same length. In this case, the lengths of the Y-axes of the first, second and third slots are stably formed in the range of 70%~110% of the lengths of the Y-axes of fourth slots, which have a perfect slot shape.

Figure 7:
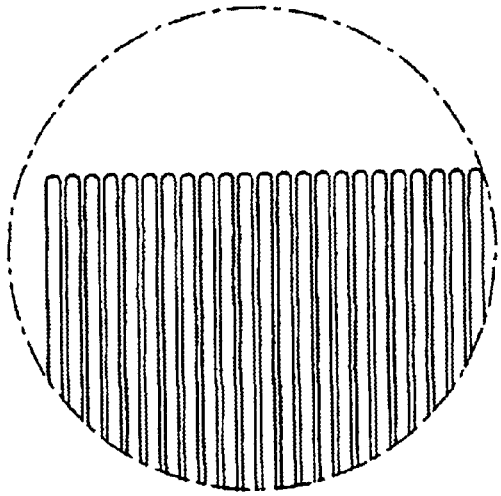
FIG. 7 is a view showing a shape of a screen of the present invention.
Figure 8:
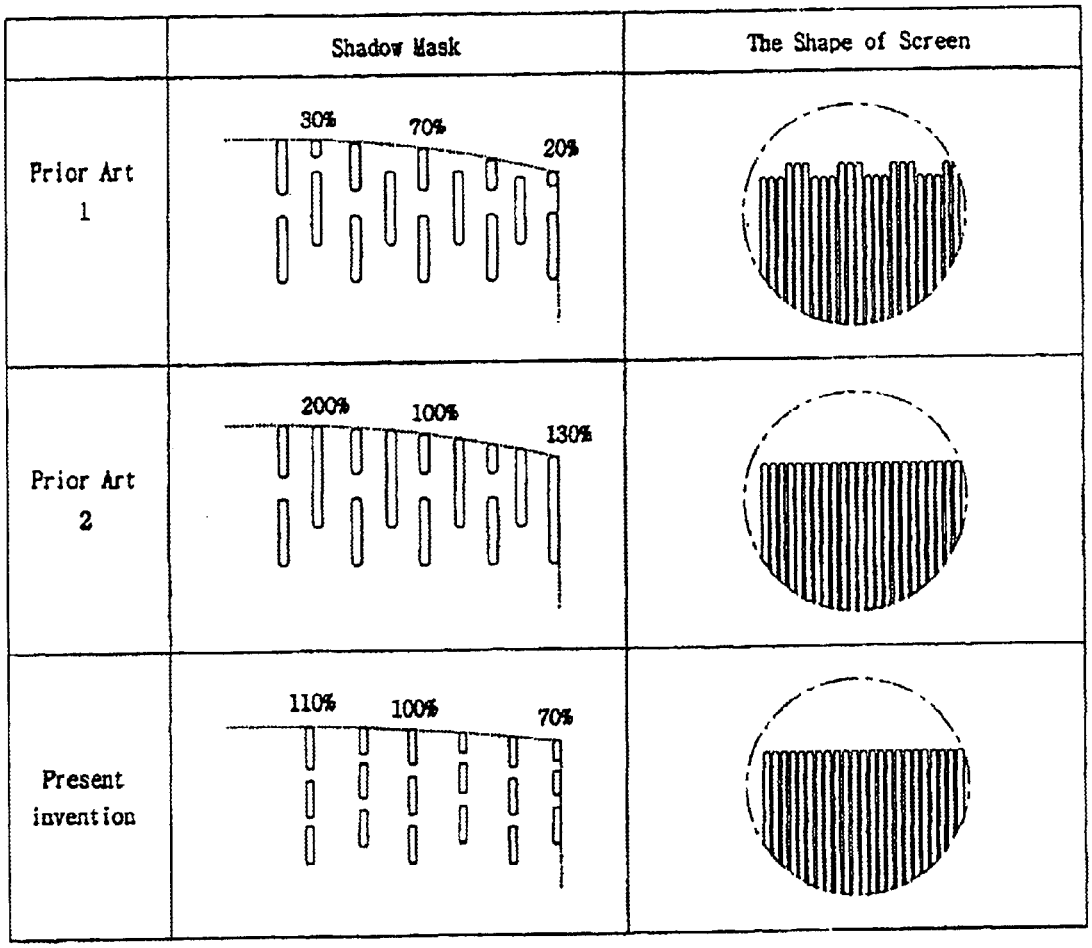
FIG. 8 is a view comparing the shape of the conventional screen and that of the screen of the present invention.

As shown in FIG. 7, the CRT having the slots formed by the above method makes a shape of the screen uniform without convexo-concave shape, thereby minimizing a stepped interval of the effective surface of the shadow mask. Moreover, the color CRT does not change the vertical interval of the slots, thereby preventing the vertical wave patterns. As shown in FIG. 8, the white spots of the end of the effective surface generated when an area of the slots is larger than an area of circumferential slots by connecting the first and second slots and stains of the periphery of the screen generated by not securing the minimum slot area required for the exposure can be prevented, thereby providing a stable screen.

Additionally, in the slots according to the present invention, because the minimum vertical directional length of the first slots is more than 64% of the minimum vertical directional length of the first slots, a difference in shadow mask transmissivity between the slots adjacent to each other is reduced, thereby reducing the white spots generated according to a difference in brightness of the electron beams.

As described above, in the present invention, when a user sees the screen from the outer surface of the panel of the color CRT, not to form the convexo-concave shape on the luminescent body radiating at the long side end and to remove the stains on the screen generated when the lengths of the outermost row slots are short, the lengths of the Y-axes of the outermost row slots arranged in the vertical axis direction of the shadow mask, the slots adjacent to the outermost row slots in the central direction of the shadow mask and the slots adjacent to the adjacent slots to the outermost row slots in the central direction of the shadow mask are maintained in the range of 70%–110% of the lengths of the slots having the perfect slot shape, thereby minimizing the stepped interval of the effective surface of the shadow mask by making the shape of the screen uniform without the convexo-concave shape, and preventing the vertical wave patterns by not changing the vertical interval of the slots. Furthermore, by connecting the outermost row slots and the adjacent slots to the outermost row slots, it is prevented that the white slots of the end of the effective surface are generated when the area of the slots is larger than that of the adjacent slots. Additionally, it is prevented that the stains of the periphery of the screen are generated when the minimum area of the slots required for exposure is not secured. Through the above effects, the present invention can provide the stable screen.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A color CRT (Cathode Ray Tube) comprising:

a panel having a luminescent screen on an inner surface thereof;

a funnel connected to the panel;

an electron gun mounted on a neck part of the funnel, the electron gun emitting electron beams toward the luminescent screen;

a shadow mask disposed in a fixed interval to the luminescent screen formed on the inner surface of the panel, the shadow mask serving to select colors; and a frame fixing and supporting the shadow mask, wherein the shadow mask includes an effective surface having a plurality of slots and a non-effective surface surrounding the effective surface, wherein the slots includes first slots, said first slots comprising each outermost slot of adjacent vertical columns of slots, and wherein a minimum length of the vertical axis direction of the first slots is greater than 63% of a maximum length of the vertical axis direction of the first slots, all of said first slots having an outer edge portion thereof connected to and extending from an edge of an effective area of the shadow mask.

2. The color CRT as claimed in claim 1, further including a horizontal row of second slots, being adjacent to the first slots and having a slot opening extending in the vertical axis direction.

3. The color CRT as claimed in claim 2, further including a horizontal row of third slots, being adjacent to the second slots in the vertical axis direction.

4. The color CRT as claimed in claim 3, further including a horizontal row of fourth slots being adjacent to the third slots in the vertical axis direction, said fourth slots being full-length slots.

5. The color CRT as claimed in claim 4, wherein smooth screen edges are obtained for the effective surface of the shadow mask at vertical lengths of the first slots between a range of 70%–110% of a vertical length of a fourth slot, inclusive.

6. The color CRT as claimed in claim 4, wherein a length of the vertical axis direction of the second slots is in the range of 70%~110% of a length of the vertical axis direction of the fourth slots.

7. The color CRT as claimed in claim 4, wherein a length of the vertical axis direction of the third slots is in the range of 70%~110% of a length of the vertical axis direction of the fourth slots.

8. The color CRT as claimed in claims 5, wherein a length of the vertical axis direction of the third slots is in the range of 70%~110% of a length of the vertical axis direction of the fourth slots.

* * * * *